US006635146B2

(12) United States Patent
Lonsky et al.

(10) Patent No.: US 6,635,146 B2
(45) Date of Patent: Oct. 21, 2003

(54) ENZYMATIC TREATMENT OF PULP TO INCREASE STRENGTH USING TRUNCATED HYDROLYTIC ENZYMES

(75) Inventors: Werner Franz Wilhelm Lonsky, Appleton, WI (US); Alberto Ricardo Negri, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 27 days.

(21) Appl. No.: 09/942,468

(22) Filed: Aug. 29, 2001

(65) Prior Publication Data

US 2002/0088575 A1 Jul. 11, 2002

Related U.S. Application Data

(63) Continuation-in-part of application No. 09/111,511, filed on Jul. 8, 1998, now abandoned.

(51) Int. Cl.[7] ..... D21H 11/20; D21H 25/02

(52) U.S. Cl. ..... 162/9; 162/72; 435/278

(58) Field of Search ..... 162/72, 190, 9; 435/277, 278

(56) References Cited

U.S. PATENT DOCUMENTS

| | | | |
|---|---|---|---|
| 2,345,543 | A | 3/1944 | Wohnsiedler et al. |
| 2,926,116 | A | 2/1960 | Keim |
| 2,926,154 | A | 2/1960 | Keim |
| 3,556,933 | A | 1/1971 | Williams et al. |
| 3,700,623 | A | 10/1972 | Keim |
| 3,772,076 | A | 11/1973 | Keim |
| 4,603,176 | A | 7/1986 | Bjorkquist et al. |
| 4,605,702 | A | 8/1986 | Guerro et al. |
| 4,608,292 | A | 8/1986 | Lassen |
| 4,675,394 | A | 6/1987 | Solarek et al. |
| 4,701,237 | A | 10/1987 | Lassen |
| 5,048,589 | A | 9/1991 | Cook et al. |
| 5,129,988 | A | 7/1992 | Farrington, Jr. |
| 5,399,412 | A | 3/1995 | Sudall et al. |
| 5,466,337 | A | 11/1995 | Darlington et al. |
| 5,494,554 | A | 2/1996 | Edwards et al. |
| 5,503,709 | A | 4/1996 | Burton |
| 5,510,001 | A | 4/1996 | Hermans et al. |
| 5,529,665 | A | 6/1996 | Kaun |
| 5,558,873 | A | 9/1996 | Funk et al. |
| 5,591,309 | A | 1/1997 | Rugowski et al. |
| 5,620,565 | A | 4/1997 | Lazorisak et al. |
| 5,759,926 | A | 6/1998 | Pike et al. |
| 5,814,188 | A | 9/1998 | Vinson et al. |
| 5,830,317 | A | 11/1998 | Vinson et al. |
| 5,853,539 | A | 12/1998 | Smith et al. |
| 5,895,710 | A | 4/1999 | Sasse et al. |
| 5,935,383 | A | 8/1999 | Sun et al. |
| 5,935,883 | A | 8/1999 | Pike |
| 5,990,283 | A | 11/1999 | Cosgrove et al. |
| 5,993,602 | A | 11/1999 | Smith et al. |
| 6,017,417 | A | 1/2000 | Wendt et al. |
| 6,027,610 | A | 2/2000 | Back et al. |
| 6,117,664 | A | 9/2000 | Schulein et al. |
| 6,241,849 | B1 | 6/2001 | Franks |

FOREIGN PATENT DOCUMENTS

| | | | |
|---|---|---|---|
| EP | 0 045 500 | A1 | 2/1982 |
| WO | WO 91/17243 | A1 | 11/1991 |
| WO | 97/27363 | * | 7/1997 |
| WO | WO 98/17854 | A1 | 4/1998 |

OTHER PUBLICATIONS

Patent Cooperation Treaty Search Report from the International Search Authority, International Application No. PCT/US 02/13532 dated Jul. 29, 2002.

Patent Abstracts of Japan 8246368: Description of Mitsubishi Paper Mills LTD, "Enzyme Treatment for Chemical Pulp for Delignification and Reforming Cellulose."

Patent Abstracts of Japan 03–185197A (Aug. 1991): Description of Japan Carlit Co LTD:The, "Tissue Paper Excellent in Dispersion in Water".

Tappi Standard Practice T 220 sp–96, "Physical testing of pulp handsheets", published by the Tappi Press, Atlanta, Georgia, corrected 1997, pp. 1–6.

Tappi Official Test Method T 430 om –94, "Copper number of pulp, paper, and paperboard", published by the Tappi Press, Atlanta, Georgia, revised 1994, pp. 1–3.

Tappi Official Test Method T 456 om–87, "Wet tensile breaking strength of paper and paperboard", published by the Tappi Press, Atlanta, Georgia, revised 1987, pp. 1–3.

Almin, K.E. and Eriksson, K–E, "Enzymic Degradation of Polymers: I. Viscometric Method for the Determination of Enzymic Activity", Biochimica et Biophysica Acta, vol. 139, 1967, pp. 238–247.

Almin, K.E. et al., "Enzymic Degradation of Polymers: II. Viscometric Determination of Cellulase Activity In Absolute Terms", Biochimica et Biophysica Acta, vol. 139, 1967, pp. 248–253.

Clark, Thomas A. et al., "Effects of enzymatic modification on radiata pine kraft fibre wall chemistry and physical properties", Appita Journal, vol. 50, No. 4, Jul. 1997, pp. 329–335.

Mansfield, Shawn D. et al., "Modifications Of Douglas–fir mechanical and kraft pulps by enzyme treatment", Tappi Journal, vol. 79, No. 8, Aug. 1996, pp. 125–132.

Oksanen, T. et al., "The effect of *Trichoderma reesei* cellulases and hemicellulases on the paper technical properties of never–dried bleached kraft pulp", Cellulose, 1997, 4, pp. 329–339.

Pere, Jaakko et al., "Effects of purified *Trichoderma reesei* cellulases on the fiber properties of kraft pulp", Tappi Journal, vol. 78, No. 6, Jun. 1995, pp. 71–78.

(List continued on next page.)

*Primary Examiner*—Steve Alvo
(74) *Attorney, Agent, or Firm*—Gregory E. Croft

(57) ABSTRACT

Papermaking fibers are treated with certain hydrolytic enzymes, specifically including cellulases, such as truncated endo-glucanases, which have been freed of their cellulose binding domain, to generate aldehyde groups at or near the surface of the fibers. Paper sheets made from the resulting fibers exhibit improved strength characteristics relative to paper sheets made from untreated fibers.

24 Claims, No Drawings

OTHER PUBLICATIONS

Richardson, J.D. et al., "Modification Of Mechanical Pulp Using Carbohydrate–Degrading Enzymes", *Journal Of Pulp And Paper Science*, vol. 24, No. 4, Apr. 1998, pp. 125–129.
Stork, Gerhard et al., "Upgrading recycled pulps using enzymatic treatment", *Tappi Journal*, vol. 78, No. 2, Feb. 1995, pp. 79–88.
Stork, G. and J. Puls, "Change in properties of different recycled pulps by endoglucanase treatment", *6th International Coference on Biotechnology in the Pulp and Paper Industry: Advances in Applied and Fundamental Research*, 1996, pp. 145–150.

* cited by examiner

ENZYMATIC TREATMENT OF PULP TO INCREASE STRENGTH USING TRUNCATED HYDROLYTIC ENZYMES

This application is a continuation-in-part of application Ser. No. 09/111,511 entitled Enzymatic Treatment Of Pulp To Increase Strength and filed in the U.S. Patent and Trademark Office on Jul. 8, 1998, and now abandoned. The entirety of application Ser. No. 09/111,511 is hereby incorporated by reference.

BACKGROUND OF THE INVENTION

In the manufacture of paper products, such as facial and bath tissues and paper towels, the wet strength and the dry strength of the product are important properties. To achieve these properties, it is common practice to add certain strengthening agents to an aqueous suspension of the papermaking fibers prior to forming the paper sheet. While effective in achieving targeted strength properties, these chemicals are expensive and may be detrimental for other properties (e.g., bulk) or can cause problems for the papermaking process when the whitewater has to be reused.

Therefore, there is a need for a less expensive and more convenient method of improving the sheet strength properties of papermaking fibers.

SUMMARY OF THE INVENTION

It has now been discovered that certain hydrolytic enzymes can randomly react with the cellulose chains at or near the surface of the papermaking fibers to create single aldehyde groups on the fiber surfaces which are part of the fiber. These aldehyde groups, the reducing ends left after random hydrolysis of β-1,4 glucosidic bonds in cellulose, become sites for cross-linking with exposed hydroxyl groups of other fibers when the fibers are formed into sheets and dried, thus increasing sheet strength. In addition, by randomly cutting or hydrolyzing the fiber cellulose chains predominantly at or near the surface of the fiber, degradation of the interior of the fiber cell wall is avoided or at least minimized. Consequently, paper or tissue made from these fibers alone, or made from blends of these fibers with untreated pulp fibers, show an increase in strength properties such as dry tensile, wet tensile, tear, z-direction tensile (surface integrity), etc.

Hence, in one aspect, the invention resides in a method for treating papermaking fibers comprising mixing an aqueous suspension of papermaking fibers and one or more hydrolytic enzymes, optionally in the presence of surfactants, optionally in the presence of other non-cellulolytic enzymes or non-hydrolytic chemical reagents, wherein aldehyde groups are formed predominantly at or near the surface of the fibers.

In another aspect, the invention resides in a method for handling the aqueous suspension of aldehyde-rich, enzyme-treated fibers comprising mechanical beating or kneading if desired, and/or mixing with supplemental chemical additives as needed.

In yet another aspect, the invention resides in a method for making a paper sheet comprising: (a) forming an aqueous suspension of papermaking fibers treated with one or more hydrolytic enzymes capable of randomly hydrolyzing cellulose or hemicellulose to create aldehyde groups; (b) feeding the aqueous suspension into a papermaking headbox; (c) depositing the aqueous suspension onto a forming fabric, whereby the fibers are retained on the surface of the forming fabric in the form of a web while water containing the hydrolytic enzyme(s) passes through the fabric; (d) collecting and recycling the water to recombine the hydrolytic enzyme(s) with additional papermaking fibers to form an aqueous suspension; and (e) drying the web to form a paper sheet.

Particular hydrolytic enzymes useful for purposes of this invention are those enzymes which randomly hydrolyze cellulose and/or hemicellulose to create aldehyde groups. Such enzymes include, without limitation, cellulases, hemicellulases, endo-cellulases, endo-hemicellulases, carboxymethylcellulases ("CMCases") and endo-glucanases. It is known that these enzymes, in particular the cellulases, will degrade the fibrous cell wall, eventually improving pliability, flexibility or softness in coarser webs, but certainly impairing tensile properties at the same time. If these enzymes are not freed of their cellulose binding domain (a step called truncation), they require the presence of a surfactant to moderate the reaction and attain the desired hydrolysis under more controlled conditions. Particularly suitable enzymes for this purpose are truncated endo-glucanases and carboxymethylcellulases, which do not require the presence of a surfactant.

For the purposes of this invention, truncated monocomponent endo-glucanases or truncated carboxymethylcellulases can be advantageous relative to multi-component cellulases because of their purity (in particular, low or no exocellulase activity) and hence greater treatment control resulting in minimal cell wall damage. However, truncated multicomponent cellulases can also work well, since the reactivity of the exo-glucanase portion is severely restricted by chance. A suitable commercially available truncated endo-glucanase is sold by Novozymes North America, Inc. (Franklinton, N.C.), under the name Novozyme® 613, SP 988 or Novozyme® 51016. A related CBD-free CMCase is the commercial preparation EG-40N offered by Clariant Corporation (Charlotte, N.C.). Still, any other hydrolytic enzymes (natural, modified or even an artificial array of peptides) which possess endo-glucanase or carboxymethylcellulase activity can essentially produce similar results.

Suitable papermaking fibers include any virgin or recycled papermaking fibers known in the art, particularly including softwood fibers, such as northern softwood kraft fibers, and hardwood fibers, such as eucalyptus fibers.

As mentioned above, if the hydrolytic enzyme is not truncated, the presence of a surfactant is preferred in the enzyme treatment step for optimal results. A preferred surfactant is a nonionic surfactant, commercially available Tween® 80 (ICI Specialties) or any of the other Tween® 60 series products which are POE sorbitan derivatives. Other suitable nonionoic surfactants include D1600® from High Point Chemical Corp.; D1600® is an alkoxylated fatty acid. Furthermore, aryl alkyl polyetheralcohol, e.g. Union Carbide's Triton® X-100 series of surfactants; alkyl phenyl ether of polyethylene glycol, e.g Union Carbide's Tergitol® series of surfactants; alkylphenolethylene oxide condensation products, e.g. Rhone Poulenc, Incorporated's Igepal® series of surfactants. In some cases an anionic surfactant may be used depending on the type of pulp used. Examples of suitable anionic surfactants are: ammonium or sodium salts of a sulfated ethoxylate derived from a 12 to 14 carbon linear primary alcohol; such as Vista's Alfonic® 1412A or 1412S; and sulfonated naphthalene formaldehyde condensates, e.g. Rohm and Haas's Tamol® SN. In some cases a cationic surfactant can be used, especially when debonding is also desired. Suitable cationic surfactants include imidazole compounds, e.g. Ciba-Geigy's Amasoft® 16-7 and Sapamine® P quaternary ammonium compounds;

Quaker Chemicals' Quaker® 2001; and American Cyanamid's Cyanatex®.

The amount of surfactant, if present, can be from about 0.5 to about 6 pounds per metric ton of pulp, more specifically from about 1 to about 5 pounds per metric ton of pulp, more specifically from about 2 to about 4 pounds per metric ton of pulp, and still more specifically from about 2 to about 3 pounds per metric ton of pulp. The specific amount will vary depending upon the particular enzyme being used and the enzyme dosage.

The extent of the hydrolytic modification will depend on the dosage of enzyme applied. The amount of enzyme administered can be denoted in terms of its activity (in enzymatic units) per mass of dry pulp. In general, endoglucanase activity ("CMCase" activity) in cellulases can be assayed by viscosimetry using carboxymethylcellulose (CMC) as a substrate. The higher the activity in a given enzyme preparation, the more pronounced the decay of viscosity will be after a given reaction (incubation) time under predefined experimental conditions. Novo Nordisk Analytical Method 302.1/1-GB, available on request, can be used to assay endoglucanase activity. It calls for the determination of the viscosity loss of a particular solution of CMC (such as Aqualon 7LFD, initial concentration 34 gpL) after 30 minutes of incubation with a given enzyme preparation at pH 7.5 (phosphate buffer) at 40° C. The method relies on the construction of a calibration curve using a standard enzyme of known carboxymethylcellulase activity such as /S, Bagsvaerd Carezyme (batch 17-1196, nominal activity 4931 ECU/g), provided by Novozymes A, Denmark. "ECU" stands for endocellulase units. Determinations of unknown activities are done relative to the standard(s) by interpolation in the calibration curve, with all preparations reacting under the same conditions. The instrument used to measure viscosity reduction is a vibrating rod viscometer, such as the MIVI 6001 unit, manufactured by Sofraser S.A., Villemandeur, France. Still, any other type of viscometer could be used, provided that the same CMC grade is used, a known CMCase standard is employed and the same incubation conditions are followed.

For purposes of this invention, enzyme dosages can vary depending on the desired extent of the treatment and can be from about 5000 to about 200,000 ECU/kilogram of oven dry fibers, more specifically from about 10,000 to about 100,000 ECU/kg, more specifically from about 10,000/kg to about 75,000 ECU/kg, and still more specifically from about 12,000 to about 60,000 ECU/kg. Mixing is desirable to achieve initial homogeneous dispersion and continuous contact between the enzyme and the substrate.

The consistency of the aqueous fiber suspension (weight percent fiber in the total pulp slurry) can be accommodated to meet usual paper mill practices. Low consistencies of about 1% or lower are workable; and consistencies as high as 16% still show sufficient enzyme activity in a pulper. For economical reasons, a consistency in the range of about 8 to about 10% is advantageous.

The reaction conditions for these enzymes can be chosen to provide a pH of about 4 to about 9, more specifically from about 6 to about 8. Temperatures can range from about 0° C. (above freezing) to about 70° C. However, it can be envisioned that in the future thermostabilized endo-glucanases could react more effectively at extreme temperatures (such as at the boiling point of water), or that alkali-stabilized endo-glucanases could react efficiently at high pH ranges (for instance at pH above 11).

Reaction times are also very flexible and depend on the application of enzyme and on the desired extent of the modification. But if kept short, fiber cell wall damage is avoided even with regular cellulases especially in the presence of surfactants. In general, suitable reaction times can be from about 10 to about 180 minutes, more specifically from about 15 to about 60 minutes.

A measure of the effectiveness of the enzyme treatment is the increase in the "copper number" of cellulose. The copper number is defined as the number of grams of copper resulting from the reduction of cupric sulfate by 100 grams of pulp. The procedure for determining the copper number is described in TAPPI Standard T 430 om-94 "Copper Number of Pulp". Historically, copper number determinations have been used to detect damage to cellulose after hydrolytic or specific oxidative treatments. An increase in reducing groups can indicate deterioration that will have a detrimental impact on mechanical strengths, since the evolution of aldehyde groups has been normally proportional to the random split of the cellulose chain and the decrease of its degree of polymerization throughout the fiber. However, for purposes of this invention, the copper number measures the improvement in the cross-linking ability of the fibers since the chemical modification is substantially restricted to the surface or the surface-near region of the fibers so as to maintain the integrity of the fiber cell walls. In general, the fibers treated in accordance with this invention have a copper number of about 0.10 or more grams of copper per 100 grams of oven-dried pulp, more specifically from about 0.10 to about 1.0 gram of copper per 100 grams of oven-dried pulp, and still more specifically from about 0.15 to about 0.70 gram of copper per 100 grams of oven-dried pulp.

The strength increases associated with the treated fibers of this invention, as measured by the dry tensile strength of handsheets made from the treated fibers of this invention compared to the dry tensile strength of handsheets made with untreated fibers, is about 40 percent or greater, more specifically about 50 percent or greater, more specifically about 60 percent or greater, more specifically about 70 percent or greater, more specifically from about 40 to about 150 percent, more specifically from about 50 to about 140 percent, still more specifically from about 60 to about 140 percent, and still more specifically from about 80 to about 140 percent. These strength increases are attributable solely to the enzymatic treatment of the fibers and is without the assistance or contribution of any other supplemental additive (s) or mechanical action that alters the fiber structure, such as refining.

Dried paper made from the treated fibers of this invention can be repulped, a new handsheet formed and dried without significant loss of the dry tensile strength.

EXAMPLES

Example 1

In order to illustrate the method of this invention, two different common papermaking fiber pulps were treated with a truncated endo-glucanase in accordance with this invention. More specifically, northern softwood bleached kraft fibers, and in a separate experiment, Brazilian eucalyptus bleached kraft pulp fibers, were treated with 83,000 ECU/Kg of Novozyme 613® for 15 to 60 minutes in a hydrapulper at 8% consistency, 40° C. and a pH of 7. The reaction was terminated with the addition of sodium hypochlorite to deactivate the enzyme. After treatment, the increase of fiber surface aldehyde groups was measured using the copper number determination.

Table 1 shows the increase of the copper numbers for the two fully bleached kraft pulps before and after treatment of the fibers with Novozyme 613®. The data listed in Table 1 under Reaction Time 0 is an indication for the number of aldehyde groups originally present throughout the fibers and not only for those placed on the fiber surfaces. To avoid the loss in mechanical strength through hydrolysis, it is essential to restrict the extent of chemical modification to the surface of the fibers, so as to maintain the integrity of the cell wall.

TABLE 1

Copper Number Determination After Hydrolysis with Novozyme 613 ®

| Reaction Time (min) | Northern Softwood | Eucalyptus |
|---|---|---|
| 0 | 0.06 | 0.07 |
| 30 | 0.17 | 0.29 |
| 60 | 0.18 | 0.32 |

As shown by the data, both fiber types underwent an increase in copper number, indicating an increase in the number of aldehyde groups created by the action of the enzyme at the surface or surface-near regions of the fiber.

Example 2

In order to illustrate the improvement in strength properties imparted to paper sheets made with the fibers treated in accordance with this invention, handsheets were made from northern softwood bleached kraft pulp and eucalyptus bleached kraft pulp fibers treated with the enzyme as described above (dosage 83,000 ECU/kg of oven-dried fibers). More specifically, handsheets having a basis weight of 60 grams per square meter were prepared by diluting a fiber sample in water to a consistency of 1.2 weight percent in a British Pulp Disintegrator and allowing the dispersed sample to soak for 5 minutes. The sample was then pulped for 5 minutes at ambient temperature, diluted to 0.3 percent consistency and formed into a handsheet on a square (9×9 inches) Valley Handsheet Mold (Voith Inc., Appleton, Wis.). The handsheet is couched off the mold by hand using a blotter and pressed wire-side up at 100 pounds per square inch for 1 minute. Then the handsheet was dried wire-side up for 2 minutes to absolute dryness using a Valley Steam Hotplate (Voith Inc., Appleton, Wis.) and a standard weighted canvas cover having a lead-filled (4.75 pounds) brass tube at one end to maintain uniform tension. The resulting handsheet was then conditioned in a humidity-controlled room (23° C., 50% relative humidity) prior to testing.

For comparison, the same northern softwood bleached Kraft fibers were treated with 83,000 ECU/Kg of Novozyme 4760-a "full" monocomponent endoglucanase, a CMCase that contains its cellulose binding domain—under identical experimental conditions.

Testing of the handsheet strength properties involved three different measures: dry tensile strength, wet tensile strength, and tear index.

Dry tensile strength is the peak load measured at the point of failure of a handsheet strip 1 inch wide and 5 inches long in an Instron Testing Machine Mini 55, running at a loading rate of 0.5 inch per minute.

Wet tensile strength is the peak load measured at the point of failure of a handsheet strip 1 inch wide and 5 inches long in an Instron Testing Machine Mini 55, running at a loading rate of 0.5 inch per minute, where the handsheet strip is wetted thoroughly as described in Tappi Standard T456 om-87.

Tear index is measured as described in Tappi Standard T220 sp-96.

Tables 2 and 3 below summarize the results.

TABLE 2

Northern Softwood Bleached Kraft Pulp Treated with CBD-Free Endoglucanase

| Reaction Time (min) | Incremental Dry Tensile Strength Change % | Incremental Wet Tensile Strength Change % | Incremental Tear Index Change % |
|---|---|---|---|
| 0 | 0 | 0 | 0 |
| 15 | 17 | −1 | 44 |
| 30 | 58 | 33 | 50 |
| 60 | 66 | 28 | 29 |

TABLE 3

Eucalyptus Bleached Kraft Pulp Treated with CBD-Free Endoglucanase

| Reaction Time (min) | Incremental Dry Tensile Strength Change % | Incremental Wet Tensile Strength Change % | Incremental Tear Index Change % |
|---|---|---|---|
| 0 | 0 | 0 | 0 |
| 15 | 32 | 29 | −7 |
| 30 | 37 | 48 | 46 |
| 60 | 39 | 20 | 70 |

The results show an increase in both dry and wet tensile strengths of the handsheets (either softwood or hardwood fibers) with time of treatment. Tear strength also increased, in contrast with the marked reduction when a full endoglucanase (containing its cellulose binding domain) is used for treatment under the same conditions (see Table 4). Table 4 summarizes the results of treatment of northern softwood Kraft fibers with Novozyme® 476. In this case, tear strength drops dramatically, showing that the intrinsic strength of the fibers has been debilitated. These results are a clear demonstration of the ability of CBD-free endoglucanases to restrict the hydrolytic effect to the outer layers of the fiber, without damage to the bulk phase.

TABLE 4

Northern Softwood Bleached Kraft Pulp Treated with Full Endoglucanase

| Reaction Time (min) | Incremental Tear Index Change % |
|---|---|
| 0 | 0 |
| 15 | −69 |
| 30 | −78 |
| 60 | −83 |

Example 3

In order to further illustrate the improvement in strength properties imparted to paper sheets made with the fibers treated in accordance with this invention, handsheets were made from northern softwood bleached kraft pulp treated with CBD-free endoglucanase Novozyme 988® under experimental conditions as described above (dosage 14,000

ECU/kg of oven-dried fibers). Table 5 below summarizes the results.

TABLE 5

Northern Softwood Bleached Kraft Pulp Treated with Novozyme 988 ®

| Reaction Time (min) | Incremental Dry Tensile Strength Change % |
|---|---|
| 0 | 0.0 |
| 30 | 79 |
| 60 | 111 |
| 120 | 136 |

Example 4

At the end of the fiber treatment reaction, enzymatic activity can be slowed down by removal of excess liquor (thickening and dilution) which contains the enzyme. Table 6 below shows the activity of an original solution and that of a recovered filtrate and a washing liquor.

More specifically, a northern softwood kraft pulp sample (30 g.o.d.) was treated at 5% consistency with a dose of Novozyme® 613 equivalent to 83,000 ECU/kg. After one hour of gentle mixing at 45° C. at pH 7, the pulp slurry was filtered under vacuum to form a fiber mat of approx. 15% consistency. The corresponding filtrate of 400 mL had an enzyme activity of 2.42_ECU/mL (1). This represents a total activity of 968 ECU or 39% recovery of the initial enzyme activity.

In a continuation of the previous experiment, the filtered pulp was further washed repeatedly by diluting the filtered fiber mat to 5% consistency and re-thickening it to approx. 15%. The produced washings (taken to a total final volume of 3.5 Lts.) still showed an enzyme activity of 0.33 ECU/mL L2), corresponding to a cumulative enzyme recovery of 85% of the theoretical amount when added to the activity in the first filtrate (1+2).

The recovered excess liquor can be recycled back into the enzymatic treatment process leading to significant cost reductions through the partial reuse of the enzyme-containing filtrate. If, however, complete inactivation of the enzyme is needed, different physical (e.g., heat) or chemical (e.g., oxidants such as hypochlorite) quenching alternatives are possible to induce irreversible denaturation of any residual enzyme.

TABLE 6

Enzymatic Activity Novozyme ® 613 Solutions Recovered by Filtration

| Sample | Filtrate ECU/mL | Activity ECU | Recovery % |
|---|---|---|---|
| initial | 4.35 | 2490 | — |
| 1 | 2.42 | 968 | 39 |
| 2 | 0.33 | 1155 | 46 |
| 1 + 2 | | 2123 | 85 |

The results of Table 6 show that most of the enzyme activity can be recovered using ordinary dewatering.

It will be appreciated that the foregoing examples, given for purposes of illustration, are not to be construed as limiting the scope of the invention, which is defined by the following claims and all equivalents thereto.

We claim:

1. A method of treating papermaking fibers comprising mixing an aqueous suspension of papermaking fibers and one or more truncated hydrolytic enzymes capable of randomly hydrolyzing cellulose and/or hemicellulose in an amount of from about 5000 to about 200,000 ECU per kilogram of fiber, wherein the dry tensile strength of handsheets made with the treated fibers, as compared to the dry tensile strength of handsheets made with untreated fibers, is increased about 40 percent or greater without the assistance of any other supplemental additives or mechanical action.

2. The method of claim 1 wherein the dry tensile strength is increased about 50 percent or greater.

3. The method of claim 1 wherein the dry tensile strength is increased about 60 percent or greater.

4. The method of claim 1 wherein the dry tensile strength is increased about 70 percent or greater.

5. The method of claim 1 wherein the dry tensile strength is increased from about 40 to about 150 percent.

6. The method of claim 1 wherein the dry tensile strength is increased from about 50 to about 140 percent.

7. The method of claim 1 wherein the dry tensile strength is increased from about 60 to about 140 percent.

8. The method of claim 1 wherein the dry tensile strength is increased from about 80 to about 140 percent.

9. The method of claim 1 wherein the aqueous suspension of papermaking fibers includes a surfactant.

10. The method of claim 1 wherein the resulting treated fibers have a copper number of from about 0.15 to about 0.50 gram of copper per 100 grams of oven-dried pulp.

11. The method of claim 1 wherein the hydrolytic enzyme is selected from the group consisting of truncated cellulases, truncated hemicellulases, truncated endo-cellulases, truncated endo-hemicellulases, truncated carboxymethylcellulases and truncated endo-glucanases.

12. The method of claim 1 wherein the hydrolytic enzyme is a truncated endo-glucanase or truncated carboxymethylcellulase.

13. The method of claim 1 wherein the aqueous suspension has a consistency of from about 1 to about 16 percent.

14. The method of claim 1 wherein the aqueous suspension has a consistency of from about 8 to about 10 percent.

15. The method of claim 1 wherein the temperature of the aqueous suspension is from about 0° C. to about 100° C.

16. The method of claim 1 wherein the temperature of the aqueous suspension is from about 20° C. to about 70° C.

17. The method of claim 1 wherein the pH of the aqueous suspension is from about 4 to about 9.

18. The method of claim 1 wherein the pH of the aqueous suspension is from about 6 to about 8.

19. The method of claim 1 wherein the dosage of the hydrolytic enzyme is from about 10,000 to about 100,000 ECU per kilogram of oven-dried pulp.

20. The method of claim 1 wherein the dosage of the hydrolytic enzyme is from about 10,000 to about 75,000 ECU per kilogram of oven-dried pulp.

21. The method of claim 1 wherein the aqueous suspension of papermaking fibers and the hydrolytic enzyme is mixed for a time of from about 10 to about 180 minutes.

22. The method of claim 1 wherein the aqueous suspension of papermaking fibers and the hydrolytic enzyme is mixed for a time of from about 15 to about 60 minutes.

23. The method of claim 1 wherein the resulting treated fibers have a copper number of about 0.10 or more grams of copper per 100 grams of oven-dried pulp.

24. The method of claim 1 wherein the resulting treated fibers have a copper number of from about 0.10 to about 1 gram of cooper per 100 grams of oven-dried pulp.

* * * * *